United States Patent [19]

Ambal

[11] Patent Number: 4,673,070

[45] Date of Patent: Jun. 16, 1987

[54] RELEASABLE ASSEMBLY FOR CONNECTING BAG MEMBERS

[75] Inventor: Gilbert Ambal, Frepillon, France

[73] Assignee: I.T.W. de France, Beauchamp, France

[21] Appl. No.: 828,867

[22] Filed: Feb. 12, 1986

[30] Foreign Application Priority Data

Feb. 26, 1985 [FR] France ..... 85 02732

[51] Int. Cl.[4] ..... A45C 3/00; A45C 5/06; A45C 13/00

[52] U.S. Cl. ..... 190/108; 190/102; 190/110; 150/111; 150/113; 383/37; 24/30.5 R; 24/665

[58] Field of Search ..... 190/100, 102, 108, 110, 190/111, 103, 109; 224/252; 248/223.4, 224.1; 150/111, 113; 383/37; 24/460, 588, 572, 663, 664, 665, 30.5

[56] References Cited

U.S. PATENT DOCUMENTS

| | | | |
|---|---|---|---|
| 778,785 | 12/1904 | Johnson | 24/588 |
| 1,567,461 | 12/1925 | Patterson | 190/102 |
| 2,372,845 | 4/1945 | Nelson | 190/108 |
| 2,428,906 | 10/1947 | Cannella | 190/108 X |
| 2,989,998 | 6/1961 | Harris | 190/108 |
| 3,631,572 | 1/1972 | Lange | 248/223.4 X |
| 3,696,850 | 10/1972 | Rosenblum | 190/108 |
| 4,122,925 | 10/1978 | Scholtheiss | 190/108 |
| 4,128,194 | 12/1978 | Hinz | 24/460 X |
| 4,256,245 | 3/1981 | Serres | 224/252 X |
| 4,424,841 | 1/1984 | Smith | 190/108 X |

FOREIGN PATENT DOCUMENTS

| | | | |
|---|---|---|---|
| 3211413 | 12/1983 | Fed. Rep. of Germany | 190/108 |
| 840343 | 7/1960 | United Kingdom | 190/110 |

*Primary Examiner*—Stephen Marcus
*Assistant Examiner*—Sue A. Weaver
*Attorney, Agent, or Firm*—Jack O'Brien; Thomas Buckman

[57] ABSTRACT

A releasable assembly is provided for connecting a pair of bags in a side by side abutting manner. The releasable assembly is comprised of a flat female member and a flat male member. The female member has a bottom side affixed to one of the bags and a top side with an open faced rectangular groove defined by spaced apart channel members. The male member has a bottom side affixed to the other bag and a top side with an outwardly projecting tongue for sliding engagement within the groove of the female member. The female member is also provided with an integral catch at one end which is engaged by a pawl member located on one end of the male member to securely retain the bags in abutting relationship. A peg at the opposite end of the female member is engaged by a notch at the opposite end of the male member to limit insertion of the male member within the female member.

1 Claim, 3 Drawing Figures

RELEASABLE ASSEMBLY FOR CONNECTING BAG MEMBERS

This invention relates to an improvement in bags generally and, in particular, sporting or fancy leather bags.

Certain of such bags are formed with pockets therein and others do not have such pockets according to the use they are intended for or depending on the aspect given them.

Most often the pocket is either realized by a slot formed into the material constituting the bag and extended by an actual pocket inside, or applied onto the bag by leaving a free edge with or without flap means and with or without closure.

Anyhow a slot is formed therein or a piece is added definitely to the bag with all inconveniences implied thereby (weakened material; most frequently, a visible fixation of the means for application of the pocket onto the bag unless visibility is desired: for example saddler's stitching to contribute to a particular aspect).

The object of this invention is to design the bag with two possibilities of use and hence two possibilities of aspect without weakening the material and the pocket (if the bag comprises one) being designed so that none of its securement means should come into sight.

In accordance with the invention the pocket constitutes a unit in itself which may be the simplest possible one or takes the particular shape of a satchel for example with flap and closure or a simple closure with a cursor, flat or with widened edge.

The pocket is associated with one of two elements of a double assembly means, the other element of which is carried by the bag itself where the pocket must be present in accordance with its selected place.

The double assembly means can be of the type with male and female elements such as a slide or slideway.

The pocket can be provided with a locking means thereby to make it retainable when it stays put.

An abutment can be implanted in any place of the assembly so as to position the pocket thereon.

Other characteristics and advantages of this invention will appear from the following description which is made in reference to the attached drawings in which.

Figure 1:
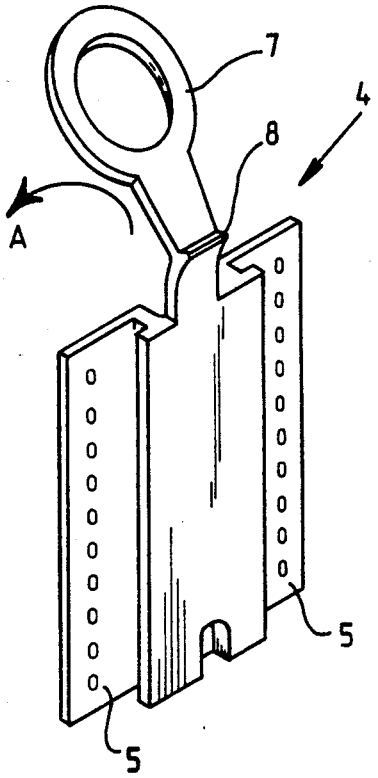
FIG. 1 represents in perspective the male element of the assembly means.
Figure 2:
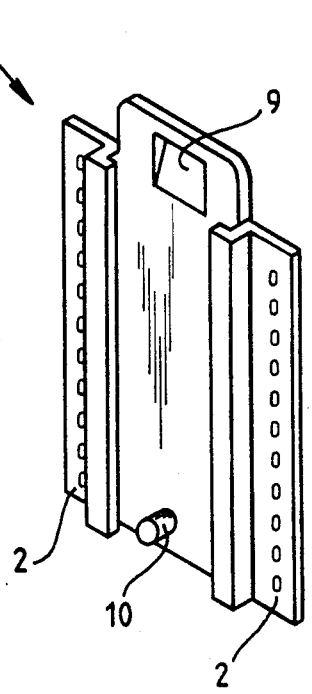
FIG. 2 represents in perspective the female element of the assembly means.
Figure 3:
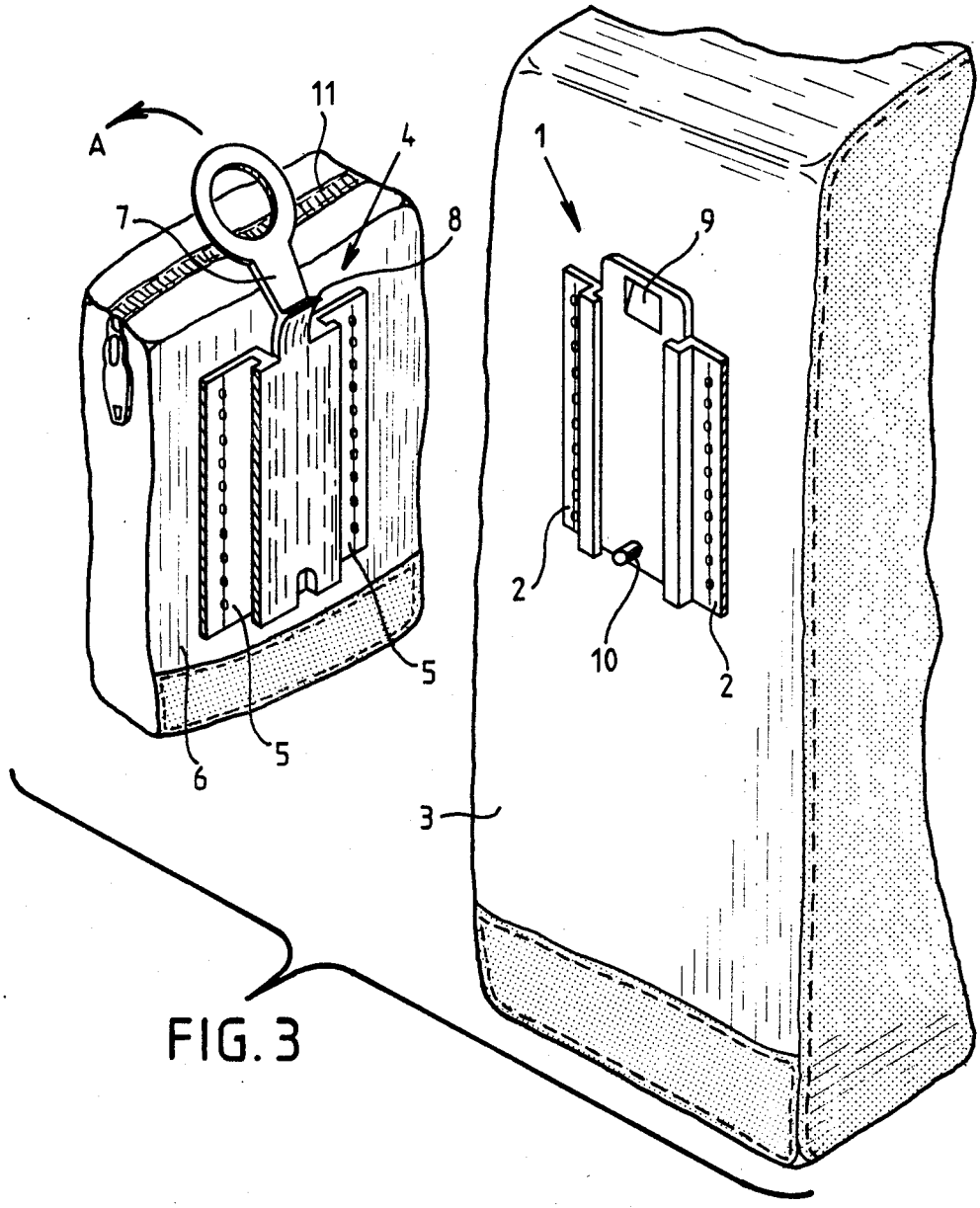
FIG. 3 is also a perspective view, as a whole, of a pocket according to the invention, equipped with the male element and of a bag portion comprising the female element thereon.

In the form of embodiment shown the assembly means is composed of two elements i.e. a female element and a male element sliding into one another, in the form of a slide or slideway.

Both elements in the slideway are made of a thermoplastic material which is both rigid and can be sewn or riveted or stuck or fixed otherwise.

The female element 1 in the slideway comprises areas 2 thereon such that it can be sewn for example to the bag 3 so as to make them integral with one another.

The male element 4 of the slideway also comprises areas 5 thereon which are used for sewing it to the pocket 6 to make them integral with one another.

Therefore it is possible to provide the bag without any pocket. In this case the female portion 1 of the slideway which is secured to the bag comes into sight, but remains discreet.

Moreover, the relatively small length of the fixation areas 2 results only in insignificant weakening of the material in these places.

If it should become necessary at a given time to mount a pocket onto the bag it would then be sufficient to make the pocket 6 slide through the intermediary of the male element 4 of the slideway, into the female element 1 thereof integral with the bag 3.

In order to render the pocket retainable when it stays put, a flexible tongue 7 of the male element 4 comprises a zone having a locking step 8 therein which is moved to engage a corresonding zone 9 in the female element 1. At this time the pocket becomes attached to the bag.

To remove the pocket it is sufficient to tip the tongue 7 over into A in order to unlock the step 8 and reversely slide the pocket through the intermediary of its male element 4 in the slideway.

An abutment 10 can be introduced into any section of the assembly to position the pocket.

It can be noted that it is easy and quick to mount and remove the unitary, self-sustained, removable pocket.

In the form of embodiment shown the pocket 6 is formed with widened edges and a zip fastener 11, thereby also permitting to utilize the pocket independently and separately as a satchel, wallet, dressing case or pouch, when it is not made integral with the bag.

Moreover the area and bulk of the assembly element comprised by the pocket are selected so as not to extend beyond the contours of the pocket itself, except for the unlocking tongue 7.

I claim:

1. A releasable assembly for connecting a pair of bag members in a side by side abutting manner comprising:

a substantially flat female receiving member having top and bottom sides wherein said bottom side is affixed to one of said pair of bag members and said top side has an open faced rectangular groove defined by two oppositely facing spaced apart channel members, said groove being opened at both ends;

a flat rectangular male insertion member having top and bottom sides wherein said bottom side is affixed to the other of said pair of bag members and said top side has an outwardly projecting tongue member for sliding engagement within said groove of said female receiving member;

a catch member integral with a first end of said female member;

a pawl member integrally hingedly connected to a first end of said male insertion member for engagement with said catch member of said female member, said pawl member having an integrally connected release lever;

a peg member integral with a second end of said female member opposite said first end of said female member within said groove of said female member; and a notch formed in a second end of said male member opposite said first end of said male member for abutment with said peg member whereby said second end of said male member is inserted into said first end of said female member and is advanced within said groove of said female member till said notch member abutts with said peg member to prevent further insertion of said male member within said female member and said pawl member ratchets within said catch member to prevent withdrawal of said male member and said release lever is accessible from the exterior of said pair of bag members to enable disengagement therein.

* * * * *